US011506191B2

(12) United States Patent
Steen et al.

(10) Patent No.: US 11,506,191 B2
(45) Date of Patent: Nov. 22, 2022

(54) REFRIGERANT COMPRESSOR DAMPING ELEMENT ARRANGEMENT

(71) Applicant: Secop GMBH, Flensburg (DE)

(72) Inventors: Helge Steen, Alt Duvenstedt (DE); Fabian Bendtfeld, Husby (DE); Sven-Eric Nielsen, Flensburg (DE)

(73) Assignee: SECOP GMBH, Flensburg (DE)

( * ) Notice: Subject to any disclaimer, the term of this patent is extended or adjusted under 35 U.S.C. 154(b) by 87 days.

(21) Appl. No.: 16/461,265

(22) PCT Filed: Nov. 16, 2017

(86) PCT No.: PCT/EP2017/079488
§ 371 (c)(1),
(2) Date: May 15, 2019

(87) PCT Pub. No.: WO2018/091596
PCT Pub. Date: May 24, 2018

(65) Prior Publication Data

US 2019/0271301 A1 Sep. 5, 2019

(30) Foreign Application Priority Data

Nov. 18, 2016 (AT) ..... A 50243/2016

(51) Int. Cl.
*F04B 39/00* (2006.01)
*F04B 39/12* (2006.01)
*F04B 53/00* (2006.01)

(52) U.S. Cl.
CPC ..... *F04B 39/0044* (2013.01); *F04B 39/00* (2013.01); *F04B 39/12* (2013.01); *F04B 39/127* (2013.01); *F04B 53/003* (2013.01)

(58) Field of Classification Search
CPC ..... F04B 39/00; F04B 39/0044; F04B 39/12; F04B 39/127; F04B 53/003
See application file for complete search history.

(56) References Cited

U.S. PATENT DOCUMENTS 3,642,268 A * 2/1972 Hipsher ..... F16F 1/387 267/281
4,243,576 A * 1/1981 Fischer ..... C08L 23/08 523/212

(Continued)

FOREIGN PATENT DOCUMENTS

AT 009772 U1 3/2008
CN 1858444 A 11/2006

(Continued)

OTHER PUBLICATIONS

Omnexus (https://omnexus.specialchem.com/polymer-properties/properties/hardness-shore-d, dated 2015) (Year: 2015).*

(Continued)

*Primary Examiner* — Nathan C Zollinger
(74) *Attorney, Agent, or Firm* — McKee, Voorhees & Sease, PLC

(57) ABSTRACT

The invention relates to a refrigerant compressor, comprising a compressor housing (1) that can be hermetically capsuled, and a compressor-motor unit (4) arranged in the housing interior (3) of the compressor housing (1), which is elastically mounted on an inner side of the compressor housing (1) by way of at least one spring element (5), wherein at least one damping element (9) made of an elastomer is provided, in order to damp the transmission of vibrations caused by the compressor-motor unit (4) to the compressor housing (1). The at least one damping element (9) is made of an elastomer that is softer compared to polyamide (PA), polybutylene terephthalate (PBT), ethylene chlorotrifluoroethylene (ECTFE).

14 Claims, 2 Drawing Sheets

(56) References Cited

U.S. PATENT DOCUMENTS

| | | | | |
|---|---|---|---|---|
| 6,251,994 | B1 * | 6/2001 | Wang | C08G 18/69 525/107 |
| 7,722,335 | B2 * | 5/2010 | Kim | F04B 39/127 417/363 |
| 9,845,798 | B2 * | 12/2017 | Miguel | F04B 39/06 |
| 2005/0265857 | A1 * | 12/2005 | Lee | F04B 39/0044 417/572 |
| 2006/0251529 | A1 | 11/2006 | Kim | |
| 2009/0243170 | A1 | 10/2009 | Nordstrom et al. | |
| 2012/0269661 | A1 * | 10/2012 | Maganhoto | F04B 39/0044 417/410.1 |
| 2013/0064643 | A1 * | 3/2013 | Vos | F04B 39/0027 415/1 |
| 2021/0363982 | A1 * | 11/2021 | Schögler | F04B 39/127 |

FOREIGN PATENT DOCUMENTS

| | | | |
|---|---|---|---|
| CN | 105531478 | A | 4/2016 |
| DE | 102005047121 | A1 | 11/2006 |
| DE | 60031540 | T2 | 5/2007 |
| DE | 102007048936 | A1 | 4/2009 |
| WO | 2015013793 | A1 | 2/2015 |
| WO | 2018091596 | A1 | 5/2018 |

OTHER PUBLICATIONS

Polymer Properties Database, "PPD" (http://polymerdatabase.com/polymer%20physics/Shore%20Table.html, dated 2015) (Year: 2015).*

Chinese Office Action related to 201780071119.X, 7 pages, dated Mar. 26, 2020.

English translation of Chinese Office Action related to 201780071119.X filed Nov. 18, 2016, 7 pages, dated Mar. 26, 2020.

"Rubber Hardness Chart", https://mykin.com/rubber-hardness-chart/, Mykin, Inc., accessed on Jan. 31, 2018, 1 page.

International Searching Authority, "International Search Report", issued in connection with International Patent Application No. PCT/EP2017/079488, dated Aug. 2, 2018, 5 pages.

International Searching Authority, "Written Opinion", issued in connection with International Patent Application No. PCT/EP2017/079488, dated Aug. 2, 2018, 8 pages.

International Searching Authority, "International Search Report", issued in connection with International Patent Application No. PCT/EP2017/079488, dated Aug. 2, 2018, 4 pages 2018.

* cited by examiner

REFRIGERANT COMPRESSOR DAMPING ELEMENT ARRANGEMENT

CROSS-REFERENCE TO RELATED APPLICATION

This application claims benefit under 35 U.S.C. § 119 or § 120 to Austrian application Serial No. GM 5024312016 filed Nov. 18, 2016, herein incorporated by reference in its entirety.

FIELD OF THE INVENTION

The invention concerns a refrigerant compressor comprising a hermetically sealable compressor housing and a compressor-motor unit disposed in an interior part of the compressor housing, said unit being elastically mounted on an inner side of the compressor housing via at least one spring element, wherein at least one damping element made of an elastomer is provided in order to dampen the transfer of vibrations produced by the compressor-motor unit to the compressor housing.

BACKGROUND OF THE INVENTION

Refrigerant compressors having a compressor-motor unit that is elastically mounted on an inner side of a hermetically sealable compressor housing via one or more spring elements are well known.

The operation of such refrigerant compressors can essentially be outlined as follows: A crankshaft driven by an electric motor causes a piston that is movably mounted in a cylinder block to make a periodic linear movement between two dead points of the cylinder, so that in an intake stroke of the refrigerant compressor, refrigerant is drawn initially through an inlet opening of the compressor housing into the housing and then from the housing into the cylinder block, and is compressed in a subsequent compression stroke. At the end of each compression stroke, the compressed refrigerant is forced out of the cylinder block and sent to an outlet opening of the compressor housing via a pressurized line.

In each case according to the operating mode of the refrigerant compressor, the movement of the piston and the crankshaft causes vibrations, which are transferred via the elastic mounting of the compressor-motor unit in the form of the spring elements, first to the compressor housing and then to the environment of the refrigerant compressor, and can lead to a sometimes considerable generation of noise.

OBJECT OF THE INVENTION

An object of this invention therefore is to provide a refrigerant compressor in which noise generation can be reduced to a minimum in correspondence with the requirements of various applications.

SUMMARY OF THE INVENTION

This problem, in the case of a refrigerant compressor comprising a hermetically sealable compressor housing and a compressor-motor unit disposed within the compressor housing, said unit being elastically mounted on an inner side of the compressor housing via at least one spring element, wherein at least one damping element made of an elastomer is provided in order to dampen the transmission of vibrations caused by the motor compressor unit to the compressor housing, is solved by the at least one damping element being made of an elastomer that is softer than polyamide (PA), polybutylene terephthalate (PBT), ethylene chlorotrifluoroethylene (ECTFE).

Through the use of an elastomer, the acoustic transmission function of the vibration system consisting of the compressor-motor unit and the at least one spring element can be affected so that specific frequency ranges can be damped or suppressed in a targeted way. In particular through the use of the damping element according to the invention at specific positions or components of the refrigerant compressor, a noise level caused by impacts of said components against each other can be considerably reduced. Because of the considerably reduced stiffness of such soft elastomers by comparison with the materials traditionally installed in generic refrigerant compressors, especially metal and thermoplastic, and the reduced sound velocity associated with them, the damping elements of the invention are especially well suited for the desired noise reduction.

A maximum reduction of the operating noise of the refrigerant compressor can be achieved by damping or interrupting the main transmission path of the mechanical noise caused by the compressor-motor unit. For this reason, it is provided in a preferred embodiment of the refrigerant compressor according to the invention that the at least one damping element is disposed between the at least one spring element and the inner side of the compressor housing or between the at least one spring element and the compressor-motor unit.

The at least one spring element that is indispensable for elastic suspension of the compressor-motor unit in the housing—for the most part a plurality of spring elements is provided, of which each is designed as a single spring—is in particular the main transmission path of the mechanical noise of the refrigerant compressor, which contributes considerably to the operating noise. The interruption of said path by means of the spring element made of an elastomer according to the invention thus reduces the transmission of mechanical noise to the compressor housing and in addition leads to a considerable reduction of collision noises caused by impacts between the spring element and the compressor housing or between the spring element and the compressor-motor unit.

In order to achieve an optimum reduction of the operating noise of the refrigerant compressor, it is provided in a particularly preferred embodiment of the invention that the damping element has a Shore A hardness with a value between 40 and 80, preferably a Shore A hardness between 50 and 65, especially preferably a Shore A hardness between 55 and 60.

Since the at least one damping element envisioned according to the invention is subjected to the high operating temperatures of up to 100° C. that prevail within the housing and is in continuous contact with the oil-refrigerant mix that is in the housing, primarily elastomers whose material property prevent too great a swelling or even a dissolving of the damping element are possibilities for use.

Thus, it is provided in an especially preferred embodiment of the refrigerant compressor according to the invention that the at least one damping element is made of a composite material comprising a fluoroelastomer (in the sense of a plastic or elastomer blend). Damping elements made of an elastomer having the trade name Viton®-A 401C from the Chemours Company have proven to be especially well suited for damping. The composition of said material leads to an especially high resistance to hydrocarbons at high temperatures, which in turn leads to a longer lifespan of the damping elements provided according to the invention. Fluoroelastomers that are produced by polymerization of two monomers, specially vinylidene fluoride and hexafluoropropylene, are particularly well suited. Likewise suitable are damping elements made of a composite material comprising hydrogenated acrylonitrile butadiene rubber and/or ethylene acrylate rubber.

To save costs and to keep the construction of refrigerant compressors according to the invention especially simple, it is provided in another especially preferred embodiment of the refrigerant compressor according to the invention that the at least one damping element is in the form of a mounting element or as a part of a mounting element, via which mounting element the at least one spring element is attached to the inside of the compressor housing, preferably by force fit.

Through such replacement of the mounting elements made of metal or thermoplastic that are conventional in traditional refrigerant compressors by the damping element envisioned according to the invention, the desired damping of the main transmission path of the mechanical noise caused by the compressor-motor unit can be achieved without increasing the number of components required for this purpose. The attachment of the spring element can be achieved, for example, by pushing the spring element onto the mounting element—as is also the case with the known compressors—and thus establishing a force-fit connection between an outer jacket surface of the mounting element and a segment of the spring element adjacent to said surface. This embodiment also has the advantage that impacts between the spring element vibrating in the operation of the refrigerant compressor and the mounting element lead to noise generation that is considerably reduced by comparison with known refrigerant compressors.

In order to be able to utilize said advantages at the connection points between the compressor-motor unit and the at least one spring element as well, it is provided in another preferred embodiment of the refrigerant compressor according to the invention that the at least one damping element is in the form of a connecting element or as a part of a connecting element, via which connecting element the at least one spring element is attached to the compressor-motor unit, preferably by force fit.

In another especially preferred embodiment of the refrigerant compressor according to the invention, it is provided that the mounting element and/or the connecting element each comprise a shape-giving inner element and a damping element forming a contact segment of the mounting element or the connecting element.

Through this, it becomes possible to give the mounting element and/or the connecting element an increased stability by means of the inner element so as to suppress excessive deflection of the spring element and, at the same time, to provide the mounting element and/or the connecting element with the damping ability according to the invention.

In order to keep the spring element from striking the inner element, which is harder than the damping element, it is provided in another preferred embodiment of the refrigerant compressor according to the invention that the damping element surrounds the inner element at its outer side that is turned toward the spring element.

This ensures that the spring element can only come into contact with the damping element forming the contact segment of the mounting element or the contacting element, and noise that might be caused by the spring element striking the inner element is avoided.

The mounting element or connecting element comprising the damping element can be made in an especially simple and inexpensive way by multicomponent injection molding. Here, the inner element, which is harder than the damping element, is made first, and the softer damping element is injected onto the inner element in an additional process step.

Therefore, it is provided in a further particularly preferred embodiment of the refrigerant compressor according to the invention that the bearing element and/or the connecting element is designed as a multi-component injection molded part.

Moreover, in another preferred embodiment of the refrigerant compressor according to the invention, an especially stable connection of the spring element to the damping element in the form of a mounting element or connecting element can be made by the at least one spring element being in the form of a helical spring and at least a segment of the at least one damping element extending into the helical spring.

The segment of the damping element extending into the internal region of the helical spring, moreover, has a function of limiting the movement of the helical spring in the horizontal direction, and the degree of vibration damping can, moreover, also be regulated through the specific choice of the length of said segment.

It is provided in another especially preferred embodiment of the refrigerant compressor according to the invention that the compressor-motor unit is mounted on the inner side of the compressor housing via four spring elements in the form of helical springs, wherein each helical spring is connected to the compressor-motor unit and/or the inner side of the compressor housing via at least one damping element.

An especially stable mounting of the overall compressor-motor unit and an optimum vibration damping can be achieved through such an arrangement. All of the main transmission paths in this case lead to at least one point, preferably to at least two points, via one damping element each, which in turn leads to an increased reduction of the mechanical sound transmitted to the compressor housing and also to a drastic reduction of impact-related noise generation.

In another preferred embodiment of the refrigerant compressor according to the invention, it is provided that the at least one damping element is made in the form of a cap.

As a result, the damping element in the form of a mounting element can be forced onto a mounting bolt disposed in the bottom region of the compressor housing and/or the damping element designed as a connecting element can be forced onto a pin-shaped extension of the compressor-motor unit, in order to counteract noise generation.

Moreover, it is provided in an especially preferred embodiment of the refrigerant compressor according to the invention that a wall thickness of the damping element is between 20% and 40%, preferably between 25% and 35%, of an inside diameter of the at least one spring element in the form of a helical spring.

Through this, an optimum noise suppression and, at the same time, an especially stable attachment of the spring element to the damping element in the form of a mounting element or as a connecting element can be achieved.

BRIEF DESCRIPTION OF THE FIGURES

The invention will now be explained in more detail by means of an embodiment example. The drawings are examples only and are intended to represent the ideas of the invention but not to limit it in any way or even to conclusively represent it.

Here.

DETAILED DESCRIPTION OF EXEMPLARY EMBODIMENTS OF THE INVENTION

Figure 1:
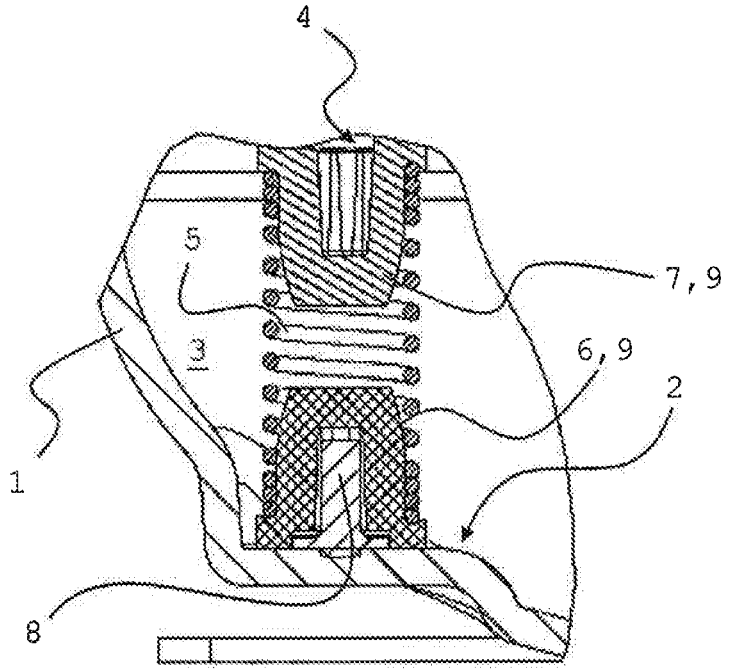
FIG. 1 shows a detail of a refrigerant compressor with damping elements made according to the invention as mounting or connecting elements.

FIG. 1 shows a detail of a compressor housing 1 of a refrigerant compressor according to the invention in a sectional view.

The plane of the section runs centrally through a first damping element 9 in the form of a mounting element 6, a spring element 5 in the form of a helical screw, via which a compressor-motor unit 4 of the refrigerant compressor disposed in an internal space 3 of the refrigerant compressor is elastically mounted on an inner side 2 of the compressor housing 1, and through a second damping element 9 in the form of a connecting element 7, wherein the spring element 5 is connected to the compressor-motor unit 4 via the connecting element 7 and to the inner side 2 of the compressor housing 1 via the mounting element 6.

In the embodiment example of the refrigerant compressor according to the invention that is shown, the compressor-motor unit 4 is mounted not via just the one spring element 5 but rather via a total of four spring elements 5, each in the form of a helical spring, to a bottom region of the compressor housing 1.

When the refrigerant compressor is in operation, the vibrations produced by the compressor-motor unit 4 are mainly transmitted to the compressor housing 1 via the spring elements 5. In order to minimize the resulting noise level, it is provided that the damping element 9 in the form of a mounting element 6 and/or the damping element 9 in the form of a connecting element 7 is made of an elastomer. The acoustic transmission function of the vibration system consisting of the compressor-motor unit 4 and the at least one spring element 5 can be affected by the choice of the elastomer so that certain frequency ranges can be damped or suppressed in a targeted way.

In particular, through the use of a damping element 9 according to the invention between each of the four spring elements 5 and the compressor housing 1 or the compressor-motor unit 4 of the refrigerant compressor, a noise level caused by impacts of said components with each other can be considerably reduced.

Since an oil sump consisting of refrigerant and oil usually forms in the bottom region of the refrigerant compressor when the refrigerant compressor is in operation, at least the damping elements 9 in the form of mounting elements 6 are usually at least partially surrounded by a lubricant-oil mixture, which has fundamentally negative effects on the lifespan of the elastomer of which the damping elements are made. In order to keep the damping elements from swelling too greatly or even dissolving, the damping elements 9 are preferably made of a composite material comprising a fluoroelastomer, for example a composite material with the trade name Viton®-A 401C.

Ideally, the composite material that is used in each case is chosen so that the damping elements swell slightly upon contact with the oil sump, which can be as hot as 100° [C], so that there is a force fit connection between spring element 5 and mounting or connecting element 6, 7, dissolving of the damping element 9 can be excluded over sufficiently long refrigerant compressor lifespans, and the Shore A hardness of the damping element 9 takes a value less than or equal to 65, since the optimum noise suppression is achieved at such a hardness.

Figure 2:
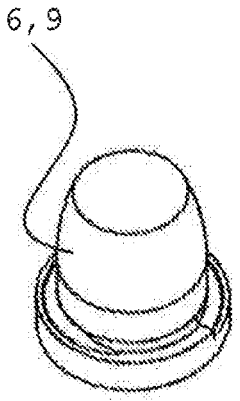
FIG. 2 shows an axonometric view of a damping element in the form of a mounting element.
Figure 3:
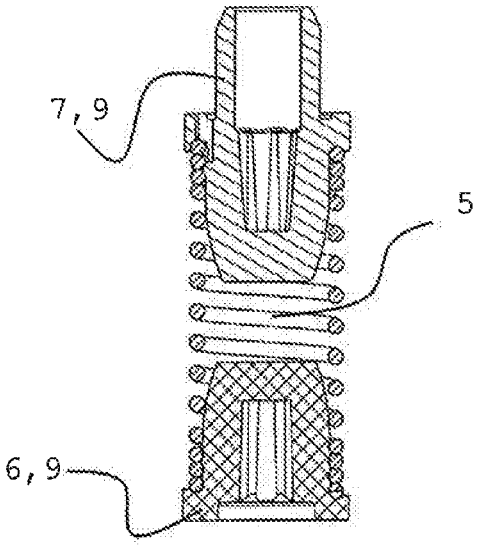
FIG. 3 shows the helical spring with a damping element and connecting element according to FIG. 1.

The cap-shaped design of the mounting element 6 or the connecting element 7 can be seen especially well in FIGS. 2 and 3, where FIG. 2 shows the damping element 9 in the form of mounting element 6 in an axonometric view and FIG. 3 shows the spring element 5 in the form of a helical spring and connected to a mounting element 6 and to a connecting element 7. The mounting element 6 in this case comprises a cylindrical jacket surface, a top wall completing said jacket surface, and, on the side away from the top wall, a stepped contact segment adjoining the jacket surface with a larger outside diameter than the cylindrical jacket surface, where the mounting element 6 contacts the bottom segment with the stepped contact segment.

The mounting element 6 thus has in its internal space a receptacle for a mounting bolt 8, which is disposed on the bottom region of the compressor housing 1 and in most cases is made in one piece with the compressor housing 1 (see FIG. 1). When the mounting element 6 is installed, it is forced onto the mounting bolt 8 so that the mounting element 6 completely surrounds the mounting bolt. The spring element 5 rests with one end on the side of the contact segment facing the spring element 5 and circumferentially surrounds the cylindrical jacket surface of the mounting element 6. Both the mounting element 6 itself and the mounting bolt 8 accommodated in the receptacle of the mounting element 6 thus project at least partly into the internal space of the spring element 5, which is in the form of a helical spring.

The connecting element 7, via which the spring element 5 is connected to the compressor-motor unit 4 when the refrigerant compressor is in operation, or when the connecting element 7 is installed, has essentially the same construction as the mounting element 6, where the connecting element 7 likewise is made in a cap shape and has a cylindrical jacket surface, a top wall completing said jacket surface, and a stepped contact segment. While the spring element 5 in the form of a helical spring contacts the side of the contact segment of the connecting element 7 facing the spring element 5 with its other end and the spring element 5 circumferentially surrounds the cylindrical jacket surface of the connecting element 7, a sleeve-shaped continuation projects from the contact segment of the connecting element 7 in the direction of the compressor-motor unit 4, so as to form an enlarged receptacle in the connecting element 7 with the receptacle surrounded by the cylindrical jacket surface. Looking in the axial direction of the connecting element 7, the sleeve-shaped continuation of the connecting element 7 has a lengthwise extension, which essentially is like that of the segment of the connecting element 7 that projects into the interior of the helical spring and forms the cylindrical jacket surface and top wall. Thus, the connecting element 7 can surround the pin-shaped continuation of the compressor-motor unit 4 even outside of the spring element 5 in order to counteract generation of noise there as well.

When the connecting element 7 is installed, the compressor-motor unit 4 projects with a pin-shaped continuation into the enlarged receptacle of the connecting element 7 and the compressor-motor unit 4 rests on a side of the stepped contact segment on the connecting element 7 turned toward the compressor-motor unit 4.

Figure 4:
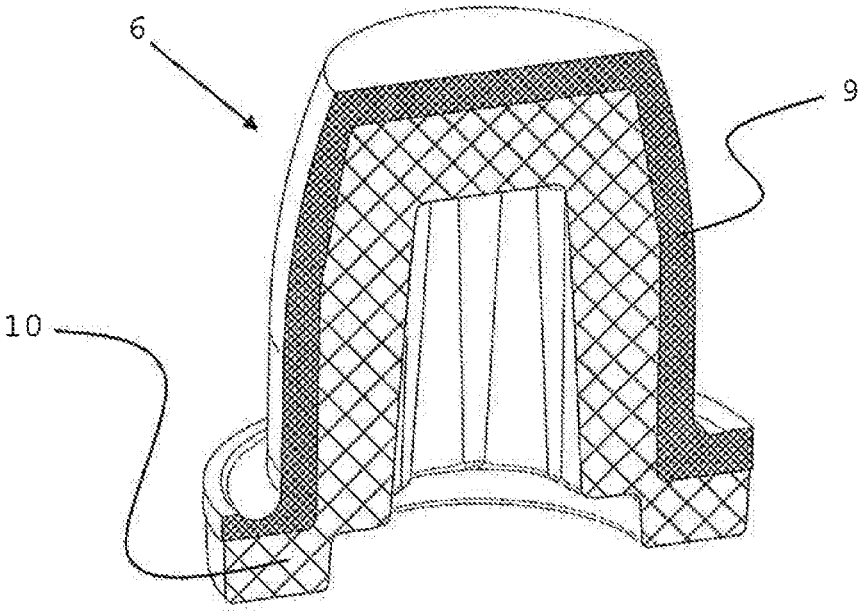
FIG. 4 shows a perspective sectional view of a damping element in the form of a part of a mounting element.

FIG. 4 shows another embodiment of a damping element 9 according to the invention. Here, the damping element 9 is in the form of a part of a mounting element 6. As such, the damping element 9 forms a contact segment of the mounting element 6, which contact segment, when the refrigerant compressor is in operation, and thus in the installed state of the damping element 9, is turned toward the spring element 5 and is in contact with this spring element 5.

The damping element 9 surrounds, at least in a segment, a shape-giving inner element 10 of the mounting element 6, which is made of a material that is harder than the damping element 9, for example polyamide (PA), polybutylene terephthalate (PBT), or ethylene chlorotrifluoroethylene (ECTFE).

Thus, both the damping element 9 itself and the shape-giving inner element 10 have a sleeve-like shape, so that the shape-giving inner element 10 can be set on the mounting bolt 8 and the damping element 9 can be forced over the shape-giving inner element 10.

The mounting element 6 of this embodiment can be made in each case as a separate damping element 9 and a shape-giving inner element 10, wherein the two components of the mounting element 6 are not assembled until the installation operation and in the operating state of the refrigerant compressor are connected to each other essentially because of the spring element 5 and the weight of the compressor-motor unit.

Alternatively, the mounting element 6 of this embodiment can, however, also be made of a multicomponent injection molded part, so that the damping element 9 is already joined to the shape-giving inner element 10 during the process of making the mounting element 6.

Similar to the structure of the mounting element 6 just described, the connecting element 7 can also comprise a shape-giving inner element and a damping element forming a contact segment surrounding, at least in a segment, the inner element and forming a contact segment and can be in the form of a multicomponent injection molded part.

REFERENCE NUMBERS

1 Compressor housing
2 Inner side of compressor housing
3 Inside space of housing
4 Compressor-motor unit
5 Spring element
6 Mounting element
7 Connecting element
8 Mounting bolt
9 Damping element
10 Inner element

What is claimed is:

1. A refrigerant compressor comprising
a hermetically sealable compressor housing and
a compressor-motor unit disposed in a housing interior of the compressor housing
and which compressor-motor unit is elastically mounted on an inner side of the compressor housing via at least one spring element,
wherein at least one damping element made of an elastomer is provided in order to dampen the transmission of vibrations caused by the compressor-motor unit to the compressor housing,
wherein the at least one damping element is disposed between said at least one spring element and the inner side of the compressor housing and a connecting element is disposed between said at least one spring element and the compressor-motor unit,
wherein the at least one damping element is in the form of a mounting element, via which mounting element the at least one spring element is attached to the inner side of the compressor housing in a way that a force-fit connection between an outer jacket surface of the mounting element and a segment of the spring element adjacent to said outer jacket surface of the mounting element is established,
wherein the at least one damping element is made of an elastomer that is softer than polyamide (PA), polybutylene terephthalate (PBT), and ethylene chlorotrifluoroethylene (ECTFE),
wherein the Shore A hardness of the at least one damping element has a value between 40 and 80,
wherein the at least one damping element is made of a composite material comprising a fluoroelastomer, and/or hydrogenated acrylonitrile butadiene rubber and/or ethylene acrylate rubber, and
wherein the mounting element and the connecting element do not overlap;
wherein one of the mounting element and connecting element comprises a shape-giving inner element, which shape-giving inner element is surrounded at least in a segment by the mounting element or connecting element to form at least a contact segment of the mounting element or the connecting element;
wherein the shape-giving inner element and associated mounting element or connecting element each have a sleeve-like shape.

2. The refrigerant compressor as in claim 1, wherein the Shore A hardness of the damping element has a value between 50 and 65.

3. The refrigerant compressor as in claim 1, wherein the damping element surrounds the inner element on an outer side of the inner element that is turned toward the spring element.

4. The refrigerant compressor as in claim 1, wherein the mounting element and/or the connecting element is in the form of a multicomponent injection molded part.

5. The refrigerant compressor as in claim 1, wherein the at least one spring element is in the form of a helical spring and the at least one damping element projects, at least in a segment, into the helical spring.

6. The refrigerant compressor as in claim 1, wherein the compressor-motor unit is mounted on the inner side of the compressor housing via four of said at least one spring elements, wherein said four spring elements are in the form of helical springs, wherein each helical spring is connected to the compressor-motor unit and/or the inner side of the compressor housing via the at least one damping element.

7. The refrigerant compressor as in claim 1, wherein the at least one damping element is made in the shape of a cap.

8. The refrigerant compressor as in claim 7, wherein a wall thickness of the damping element is between 20% and 40% of an inside diameter of the at least one spring element in the form of a helical spring.

9. The refrigerant compressor as in claim 2 wherein the Shore A hardness of the at least one damping element has a value between 55 and 60.

10. The refrigerant compressor as in claim 1, wherein the at least one spring element is attached to the compressor-motor unit by a force fit.

11. The refrigerant compressor as in claim 5, wherein a wall thickness of the damping element is between 20% and 40% of an inside diameter of the at least one spring element in the form of a helical spring.

12. The refrigerant compressor as in claim 6, wherein a wall thickness of the damping element is between 20% and 40% of an inside diameter of the at least one spring element in the form of a helical spring.

13. The refrigerant compressor as in claim 7, wherein a wall thickness of the damping element is between 25% and 35% of an inside diameter of the at least one spring element in the form of a helical spring.

14. A refrigerant compressor comprising a hermetically sealable compressor housing and a compressor-motor unit disposed in a housing interior of the compressor housing, which compressor housing is elastically mounted on an inner side of the compressor housing via at least one spring element, wherein at least one damping element made of an elastomer is provided in order to dampen the transmission of vibrations caused by the compressor-motor unit to the compressor housing, wherein the at least one damping element is disposed between said at least one spring element and the inner side of the compressor housing, and a connecting element is disposed between said at least one spring element and the compressor-motor unit, wherein the at least one damping element is in the form of a mounting element, via which mounting element the at least one spring element is attached to the inner side of the compressor housing in a way that a force-fit connection between an outer jacket surface of the mounting element and a segment of the spring element adjacent to said outer jacket surface of the mounting element is established, wherein the at least one damping element is made of an elastomer that is softer than polyamide (PA), polybutylene terephthalate (PBT), and ethylene chlorotrifluoroethylene (ECTFE), wherein the Shore A hardness of the at least one damping element has a value between 40 and 80, wherein the at least one said damping element is made of a composite material comprising a fluoroelastomer, and/or hydrogenated acrylonitrile butadiene rubber and/or ethylene acrylate rubber, and wherein the mounting element and the connecting element do not overlap;

further comprising at least one damping element that is disposed between the at least one spring element and the compressor-motor unit, wherein one of the mounting element and connecting element comprises a shape-giving inner element, which shape-giving inner element is surrounded at least in a segment by the mounting element or connecting element to form at least a contact segment with the mounting element or the connecting element, wherein the shape-giving inner element and associated mounting element or connecting element each have a sleeve-like shape.

* * * * *